US005601279A

United States Patent [19]

Schwartz et al.

[11] Patent Number: 5,601,279

[45] Date of Patent: Feb. 11, 1997

[54] PICKET FENCE INCLUDING SLATS HAVING U-SHAPED ATTACHMENT RAILS

[75] Inventors: Carl I. Schwartz, Grand Blac, Mich.; Robert L. Kniss, St. Louis, Mo.; William D. Goslin, Clio, Mich.; Richard W. Cantley, Troy, Mich.; James Grzybowski, Lapeer, Mich.; James Gruda, Rochester, Mich.

[73] Assignee: Plastics Research Corporation, Flint, Mich.

[21] Appl. No.: 481,054

[22] Filed: Jun. 7, 1995

[51] Int. Cl.[6] ..... E04H 17/14

[52] U.S. Cl. ..... 256/66; 256/24; 256/19

[58] Field of Search ..... 256/66, 65, 59, 256/72, 24, 19

[56] References Cited

U.S. PATENT DOCUMENTS

| | | | |
|---|---|---|---|
| 193,944 | 8/1877 | Green et al. | 256/72 X |
| 1,136,999 | 4/1915 | Bondy | 256/24 |
| 2,237,669 | 4/1941 | Higman | 256/19 X |
| 2,573,239 | 10/1951 | Barrett . | |
| 2,685,432 | 8/1954 | Murray, Jr. . | |
| 2,766,967 | 10/1956 | Roberts . | |
| 2,919,112 | 12/1959 | Cofield . | |
| 3,212,754 | 10/1965 | Revell et al. . | |
| 3,411,752 | 11/1968 | Bos . | |
| 3,554,494 | 1/1971 | Bee | 256/59 X |
| 3,801,072 | 4/1974 | Newberry, Jr. | 256/24 X |
| 4,078,772 | 3/1978 | Carbone | 256/24 |
| 4,130,272 | 12/1978 | Emmie . | |
| 4,181,764 | 1/1980 | Totten | 256/19 X |
| 4,324,388 | 4/1982 | Klaser . | |
| 4,493,579 | 1/1985 | Rautakoura . | |
| 4,540,160 | 9/1985 | Zanavich et al. | 256/19 |
| 4,625,948 | 12/1986 | Lustvee . | |
| 4,722,514 | 2/1988 | Pettit | 256/66 X |
| 5,421,556 | 6/1995 | Dodge et al. | 256/19 X |

FOREIGN PATENT DOCUMENTS

| | | | |
|---|---|---|---|
| 2496153 | 6/1982 | France | 256/19 |

*Primary Examiner*—Anthony Knight
*Attorney, Agent, or Firm*—Brooks & Kushman P.C.

[57] ABSTRACT

A modular fence construction for use with a pair of posts installed in a ground mass. The posts are laterally spaced from each other and have at least one transverse support member affixed thereto. The modular fence construction comprises a plurality of pickets and at least one transverse rail affixed to the plurality of pickets. The transverse rail includes a channel adapted to receive the at least one transverse support member. The plurality of pickets and the at least one transverse rail are formed as a unitary piece and are adapted to mate with like unitary pieces to provide the modular fence construction.

32 Claims, 6 Drawing Sheets

Fig. 1
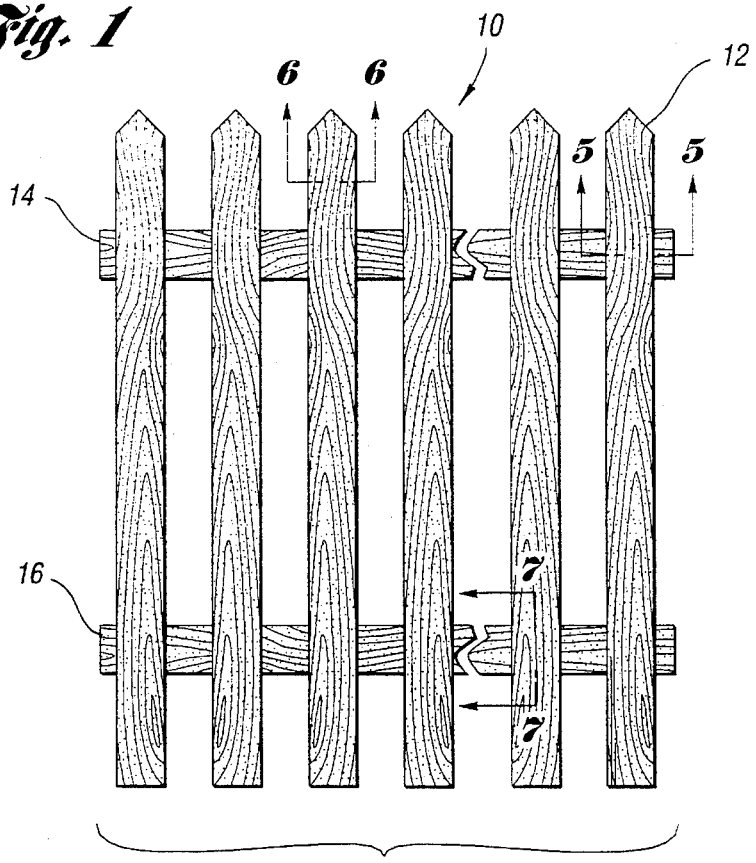
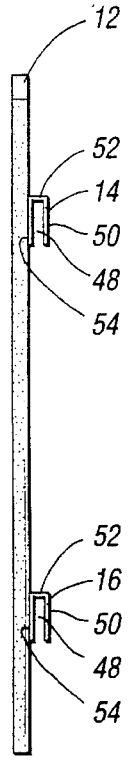
Fig. 3
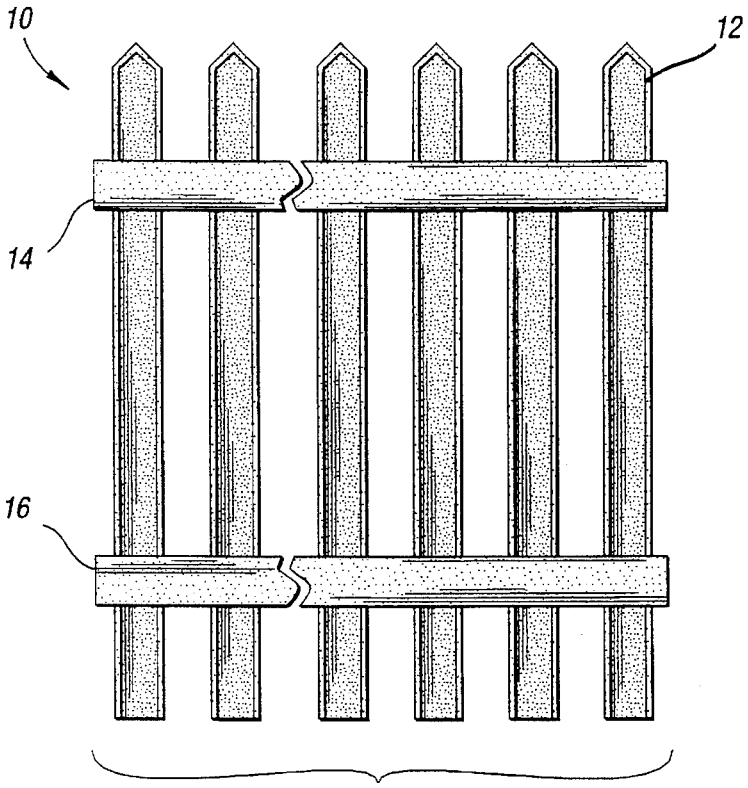
Fig. 2

Fig. 9
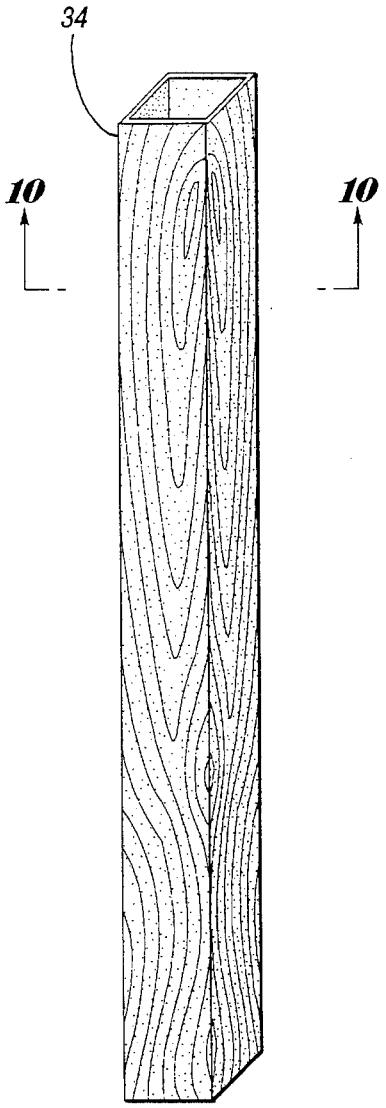
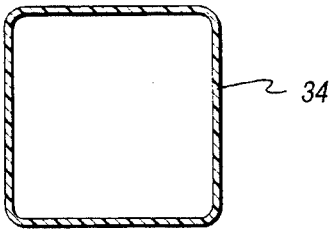
Fig. 10
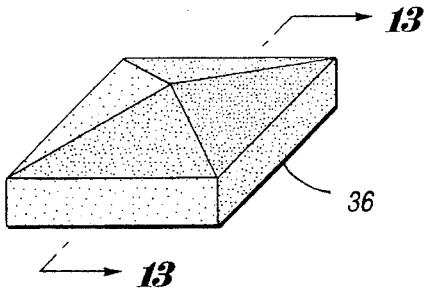
Fig. 11
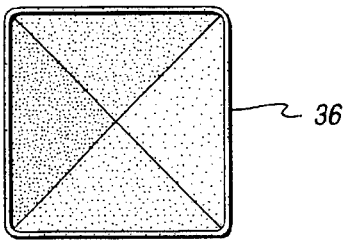
Fig. 12
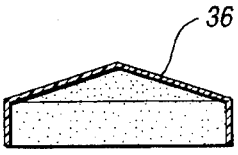
Fig. 13

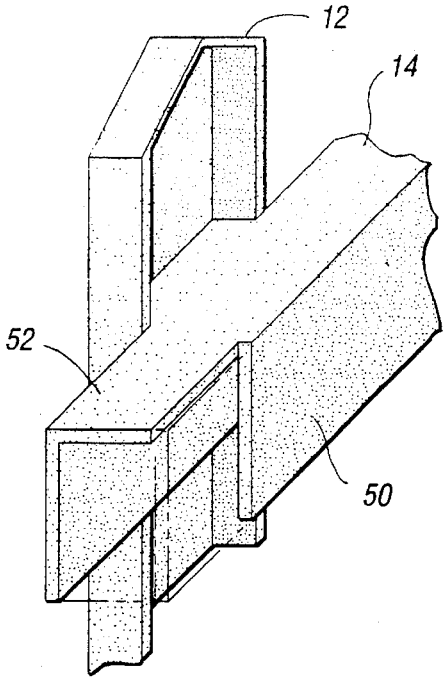
Fig. 17
Fig. 19
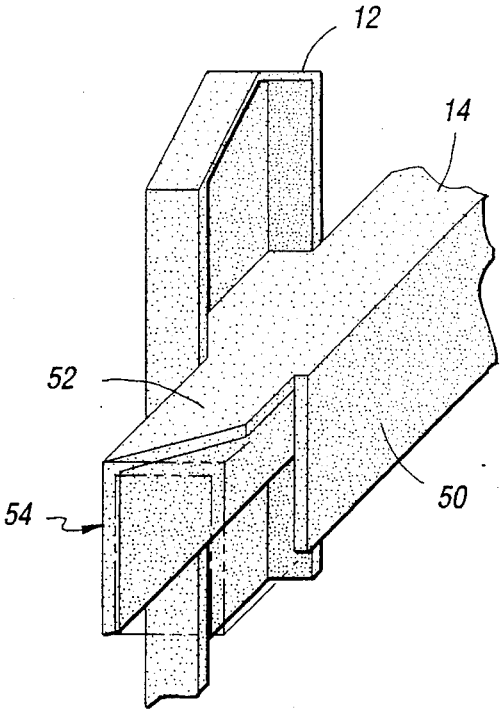
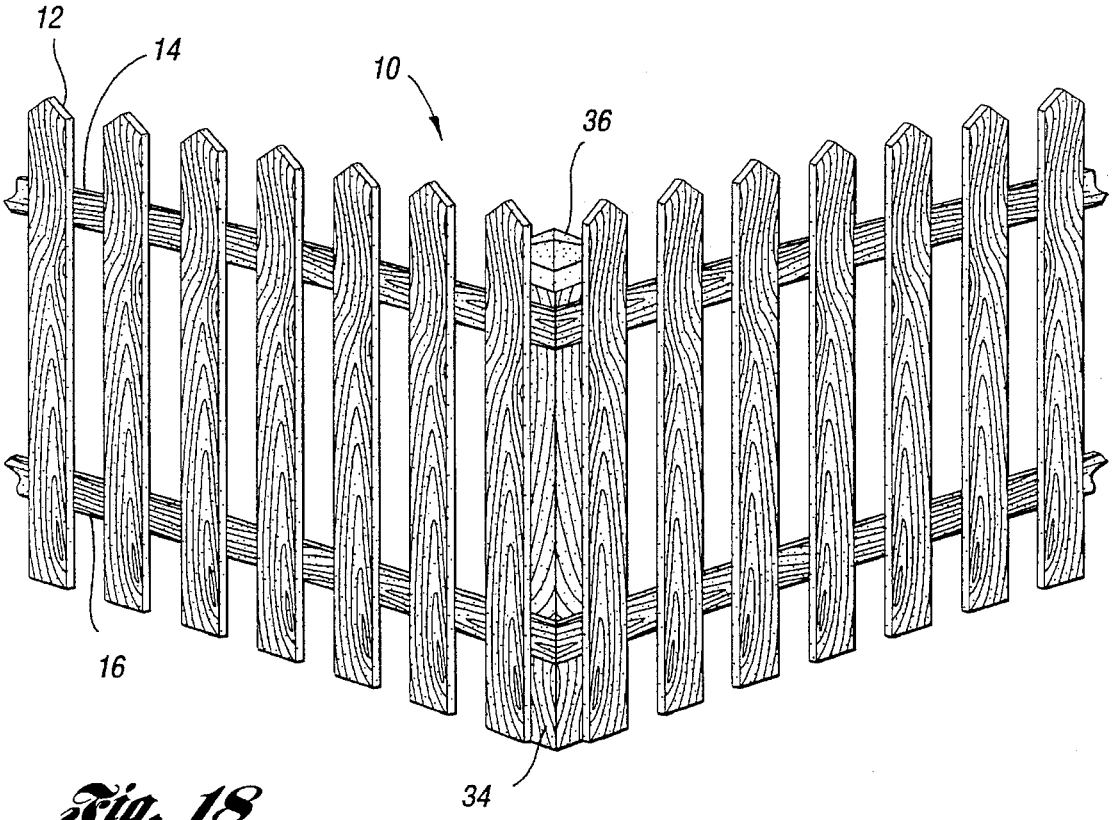
Fig. 18

PICKET FENCE INCLUDING SLATS HAVING U-SHAPED ATTACHMENT RAILS

TECHNICAL FIELD

This invention relates to a modular fence construction and method.

BACKGROUND ART

Since the time when land could first be owned and recorded, persons have sought ways to define and mark the metes and bounds of their property. Where natural barriers existed, such as streams, trees and mountains, markings were simplified. Where these barriers were absent, however, other methods were resorted to. Thus, stone stanchions, brick walls, barbed wire and wooden fencing have been used in one form or another.

In ancient times, property markings and related man-made walls or fencing were used for defensive purposes to protect against invasion by outsiders. Today, the typical use of fencing has a loftier purpose. In most cases, this "picket-fencing", as it has become known, is used to restrain and protect children and pets. In some instances, it is also used purely for decoration, such as around gardens, ponds, walkways, etc.

Picket fences have traditionally been made from wood. Although wood enables a relatively simple construction, it also has numerous disadvantages. Namely, it is subject to rot and thus requires regular maintenance in the form of painting, staining, post replacement, rebuilding, etc. The assembly of typical wooden fences is also time consuming and tedious. Usually, the individual pickets and horizontal rails have to be cut to length and assembled. Substantial care must also be taken when cutting the pickets and rails to ensure the desired appearance. The fence must then be assembled using nails or screws and, of course, cannot be readily disassembled and reassembled if it is desired to move the fence to an alternative location.

Against this background, various proposals have been made for forming picket fences and the like from materials other than wood. See, for example, U.S. Pat. Nos. 2,573,239 to Barrett, 2,685,432 to Murray, 2,766,967 to Roberts, 2,919,112 to Cofield, 3,212,754 to Revell, 3,411,752 to Bos, 4,625,948 to Lustvee, and 4,130,272 to Emmie. Each of these references discloses a relatively complex arrangement for manufacturing and installing a picket fence comprised of steel.

The Barrett U.S. Pat. No. 2,573,239 discloses a sheet metal picket fence arrangement. As shown, horizontal stringers and vertical pickets are fastened together by introducing projections on the stringers into openings in the pickets. The pickets have a complex cross-section necessary for such assembly. In addition, the stringers are fastened to the corner posts using bolts.

The Murray U.S. Pat. No. 2,685,432 discloses a metallic picket fence construction wherein certain pickets have bottom extensions for insertion into the ground. The pickets are fastened to the flexible rail strips by introducing projections on the pickets into openings on the rails strips. Mating rail strips are connected to each other through the use of fasteners.

The Roberts U.S. Pat. No. 2,766,967 discloses a knock-down fence construction and incorporates horizontal metal straps with tabs punched out from it. Also included are vertical slats with notches cut in the edges. As disclosed, the notches correspond to the punched tabs, and the slats are bowed, so as to enable them to engage the tabs. Although intended as a light-weight low fence for the edge of flower beds and similar applications, the horizontal rails slats do not provide a rigid construction. Moreover, the tab and notch arrangement prevents the slats to be aligned in anything but a right angle to the horizontal rails. Still further, after assembly, there is no means provided to permanently secure the slats in position. As a result, they can be accidentally or deliberately removed.

The Cofield U.S. Pat. No. 2,919,112 discloses a collapsible fence arrangement. As shown, horizontal stringers and vertical pickets are permanently rivetted together to enable relative rotation between them. As is readily seen, however, this arrangement does not permit easy disassembly.

The Revell U.S. Pat. No. 3,212,754 discloses an interlocking fence structure. A top rail specially formed with slots and tongues for engagement with vertical pickets. The pickets are similarly provided with a complex cross-section and projections for securing them in the top rail.

The Bos U.S. Pat. No. 3,411,752 discloses a guardrail construction, such as a balcony balustrade. Generally, I-section vertical members are provided which are accommodated in corresponding openings of top and bottom horizontal rails. As disclosed, pins secure the vertical members in the horizontal rails. A sheet form hand rail is further provided to cover the tops of the vertical members protruding through the top horizontal rail.

U.S. Pat. No. 4,625,948 to Lustvee discloses a picket fence construction having a transverse rail and a plurality of pickets adapted to be mounted in the rail. The pickets are hung by means of a tongue and engaging link arrangement. The rail includes a tongue for each picket, and each picket includes an engaging link. In the alternative, the tongue and links may be reversed.

U.S. Pat. No. 4,130,272 to Emmie discloses a picket fence having a plurality of parallel and laterally spaced metal pickets which are interconnected by a plurality of parallel pairs of stringers. The stringers are made from a metal material and have opposite ends shaped in a tubular configuration which are received in mating recesses on adjacent, parallel pickets such that the pickets are rotatable about the tubular configurations of the stringers. The pickets and their associated stringers are thus movable with respect to each other in such a manner that the pickets may be disposed along a curved path.

In an effort to overcome the difficulties of the aforementioned metallic fence constructions, efforts have also been directed to the design and manufacture of plastic resin structures. See, for example, U.S. Pat. No. 4,324,388 to Klaser, which discloses a fence structure wherein the components are fabricated from a plastic resin and where the corner, line or gate post present positive anchoring with ready installation. Although less complex than the above metallic designs, the all plastic resin approach of Klaser is far less secure and creates new difficulties in installation through the use of its component post anchors.

Consequently, a need has developed for an improved fence structure which may be easily installed and maintained and which provides a sturdy structure to serve both protective and ornamental purposes.

SUMMARY OF THE INVENTION

It is a principal object of the present invention to provide a modular fence construction and method which may be quickly and easily installed and maintained.

It is a further object of the present invention to provide an improved fence construction and method which may be readily and easily disassembled and reassembled.

Yet still further, it is an object of the present invention to provide a modular fence construction and method which may be used with a pair of posts installed in a ground mass, laterally spaced from each other and having at least one transverse support member affixed thereto.

In carrying out the above objects and other objects, features and advantages of the present invention, the modular fence construction includes a plurality of pickets having at least one transverse rail affixed thereto. The rail further includes a channel adapted to receive the at least one transverse support member which is affixed to the installed pair of posts. The plurality of pickets and the transverse rail are formed as a unitary piece and are adapted to mate with like unitary pieces.

In a preferred embodiment, there are two transverse support members, namely a top support member and a bottom support member. Similarly, there are two transverse rails affixed to the plurality of pickets, namely a top rail and a bottom rail. Each of the rails includes a channel adapted to receive its corresponding support member. Still further, in the preferred embodiment, the pair of posts are substantially vertical, and the transverse support members are substantially horizontal.

In this preferred embodiment, each of the transverse support members has a top face portion, a bottom face portion, a front face portion, and a rear face portion. Each of the rails similarly includes a rear portion adapted to cover the rear face portion of its corresponding support member, a top portion adapted to cover the top face portion of its corresponding support member and a front portion adapted to cover the front face portion of its corresponding support member. There is further provided a pair of hollow sleeves, each of which is adapted to receive and protect a corresponding post. Still further, there is provided a pair of post caps, each of which is adapted to receive a corresponding hollow sleeve.

In the preferred embodiment described above, each of the posts includes a bottom installable portion, a top portion, and a face portion extending therebetween. The hollow sleeves are thus adapted to receive and protect the face portion of their corresponding post. Similarly, the post caps are adapted to cover and protect the top portions of their corresponding fence posts.

In keeping with the invention, an improved fence construction method is also provided. The method includes the initial installation of a pair of laterally spaced posts in a ground mass. At least one transverse support member is thereafter affixed to the pair of installed posts. A plurality of pickets having at least one transverse rail affixed thereto and together formed as a unitary piece, is provided. The transverse rail includes a channel adapted to receive the at least one support member. Finally, the channel means may be mated to the at least one support member so as to affix the unitary piece thereto.

Again, in the preferred embodiment of the construction method, each of the installed posts includes a bottom installable portion, a top portion, and a face portion extending therebetween. A pair of hollow sleeves are also provided. Each of the sleeves is adapted to receive and protect the face portion of the corresponding posts. At each of the hollow sleeves, the corresponding fence post portion is received and, thereafter, at least one transverse support member is affixed to the pair of installed posts. A plurality of pickets having at least one transverse rail affixed thereto is thereafter provided as a unitary piece. Again, the rail includes a channel adapted to receive the at least one support member. The channel is thus mated with the at least one support member so as to affix the unitary piece thereto. Still further, a pair of post caps are provided, each of which is adapted to receive a corresponding hollow sleeve to cover and protect the fence post top portion. Finally, the corresponding hollow sleeves are received in each of the post caps.

The above objects and other objects, features, and advantages of the present invention are readily apparent from the following detailed description of the best modes for carrying out the invention when taken in connection with the accompanying drawings wherein like reference numerals correspond to like components.

BRIEF DESCRIPTION OF THE DRAWINGS

FIG. 1 is a front elevational view of the modular fence construction of the present invention;

FIG. 2 is a rear elevational view of the modular fence construction of the present invention;

FIG. 3 is a side elevational view of the modular fence construction of the present invention;

FIG. 9 is a schematic diagram of the hollow sleeve used in accordance with the present invention to cover and protect the installed posts;

FIG. 10 is a partial cross-section of the hollow sleeve of FIG. 9 taken along line 10—10;

FIG. 11 is a perspective view of the post cap;

FIG. 12 is a bottom plan view of the post cap of FIG. 11;

FIG. 13 is a partial cross-sectional diagram of the post cap of FIG. 11 along the line 13—13;

FIG. 17 is a schematic diagram illustrating the cut-out rear portion of the rail where it comes in contact with the post serving as a line post as in FIG. 16 used in accordance with the present invention;

FIG. 18 is a fragmentary front perspective view of a corner section of the modular fence construction of the present invention;

FIG. 19 is a schematic diagram illustrating the cut-out rear portion of the rail end with an additional angled cut where it comes in contact with the post serving as a corner post as in FIG. 18 used in accordance with the present invention.

BEST MODES FOR CARRYING OUT THE INVENTION

The modular fence construction of the present invention is shown more particularly in FIGS. 1–7 of the drawings. As seen, the construction 10 includes a plurality of pickets 12 having at least one transverse rail 14 affixed thereto. In a preferred embodiment, rail 14 functions as the top rail and there is similarly provided a bottom rail 16. Pickets 12 are substantially vertical and are laterally spaced from one another. To achieve decorative purposes, however, pickets 12 could be arranged having other orientations and spacings. For example, they could be provided in non-vertical configurations, might include designs therebetween or, for that matter, could abut directly against one another without any spacing therebetween.

Figure 4:
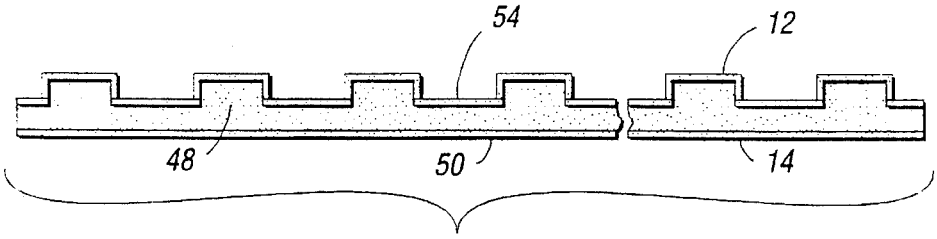
FIG. 4 is a bottom elevational view of the modular fence construction of the present invention.
Figure 5:
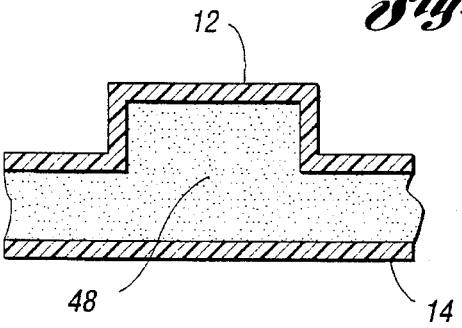
FIG. 5 is a partial cross-sectional view of the modular fence construction of the present invention taken along line 5—5 of FIG. 1.
Figure 6:
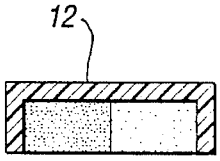
FIG. 6 is a partial cross-sectional view of the modular fence construction of the present invention taken along line 6—6 of FIG. 1.
Figure 7:
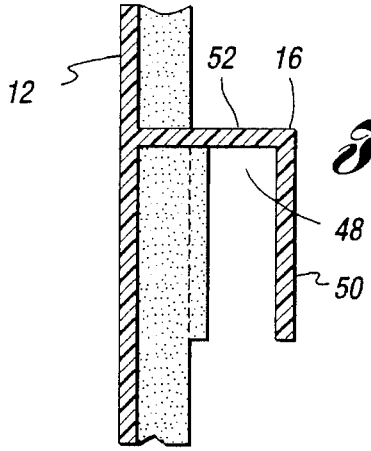
FIG. 7 is a partial cross-sectional view of the modular fence construction of the present invention taken along line 7—7 of FIG. 1.
Figure 8:
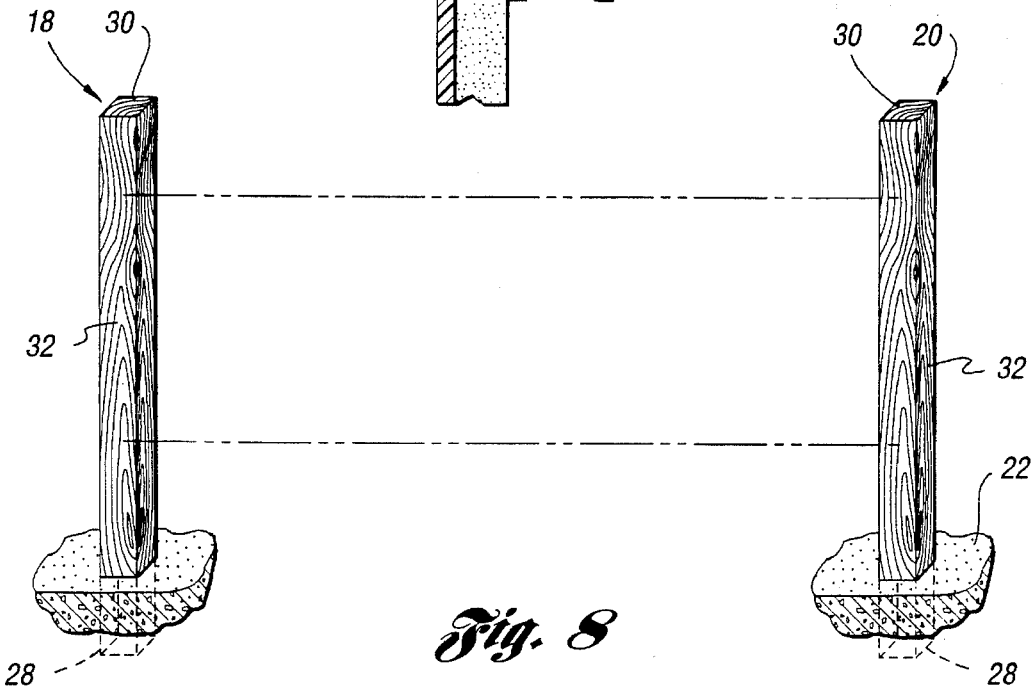
FIG. 8 is a schematic diagram of the laterally spaced posts used in accordance with the present invention.
Figure 16:
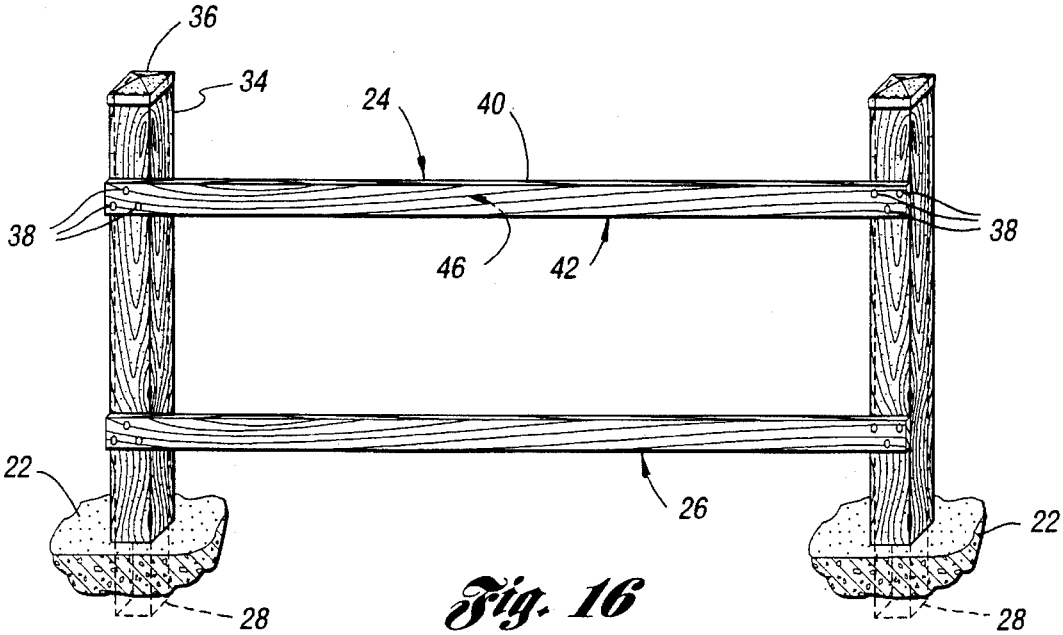
FIG. 16 is a schematic diagram illustrating the relationship of the laterally spaced posts of FIG. 8 to the upper and lower support members used in accordance with the preferred embodiment of the present invention.

The modular fence construction described herein is specifically directed for use with a pair of posts 18 and 20 such as those shown in FIGS. 8 and 16 of the drawings. The posts are installed in a ground mass 22 and include at least one transverse support member 24 affixed thereto. As shown in FIG. 16, in the preferred embodiment, there are two transverse support members, namely a top support member 24 and a bottom support member 26. Although posts 18 and 20 may be of any three dimensional shape, it is preferable that they have a bottom installable portion 28, a top portion 30 and a face portion 32 extending therebetween. In the example shown, posts 18 and 20 are of a 4×4 configuration.

Figure 14:
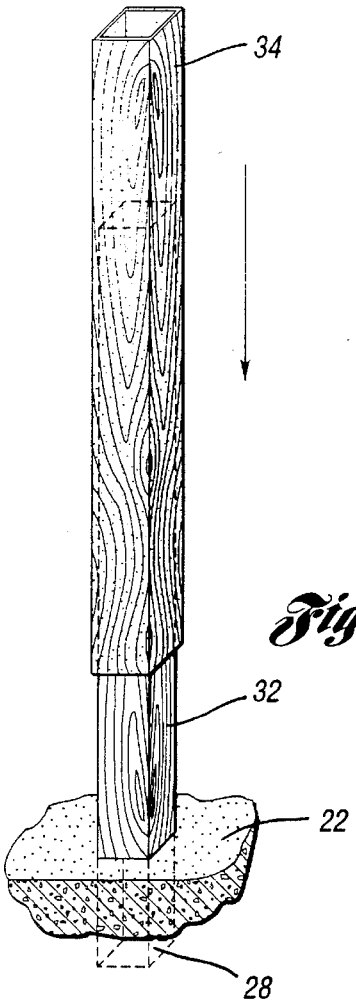
FIG. 14 is a schematic diagram illustrating the installation of the hollow sleeve of FIG. 9 with one of the installed posts of FIG. 8.
Figure 15:
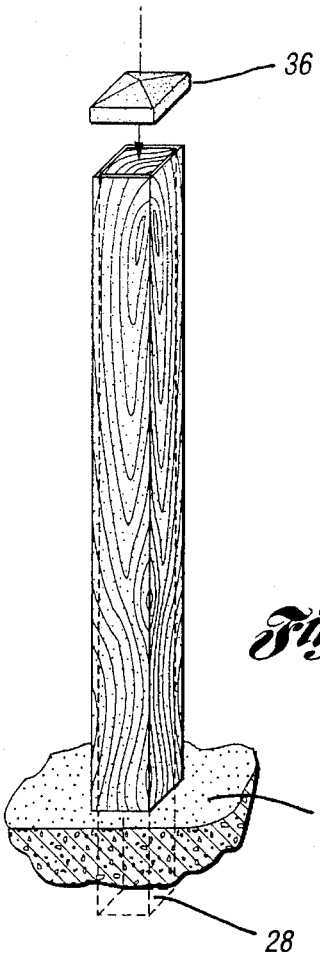
FIG. 15 is a schematic diagram illustrating the installation of the post cap of FIG. 11 with a hollow sleeve and a post.

In the preferred embodiment, the invention further includes a sleeve 34 shown in FIG. 9 which is adapted to receive and cover the face portion 32 of fence post 18 as shown in FIG. 14. There is further provided a post cap 36 as shown, for example, in FIGS. 11–13, which is adapted to receive sleeve 34 as shown in FIG. 15. Post cap 36 may, of course, be of any suitable design so long as it functions to cover the top of sleeve 34 and provide a substantially water-tight seal so as to prevent water, air and other contaminants from entering sleeve 34 and coming in contact with the enclosed post 18.

After posts 18 and 20 have been received and covered by corresponding sleeves and post caps, horizontal support members 24 and 26 may be affixed thereto. In the preferred embodiment, these horizontal support members are comprised of wood and may be of any suitable shape such as, for example, a 1×3 slat. Support members 24 and 26 may be affixed directly to posts 18 and 20 with screws 38 or the like protruding directly through sleeves 34. In the preferred embodiment, support members 24 and 26 have a top face portion 40, a bottom face portion 42, and front face portion 44, and a rear face portion 46.

Returning to FIGS. 1–7 of the drawings, it can be seen that rails 14 and 16 include a channel 48 which is adapted to receive its corresponding support member. In the case of an embodiment wherein a top and bottom support member are utilized, fence construction 10 will thus incorporate a top and bottom rail. The rail comprises a rear portion 50 adapted to cover the rear face portion 46 of its corresponding support member, a top portion 52 adapted to cover the top face portion 40 of its corresponding support member, and a front portion 54 adapted to cover the front face portion 44 of its corresponding support member.

The post will typically either serve as a line post as in FIG. 16 or a corner post as in FIG. 18. FIG. 17 illustrates the cut-out rear portion of the rail where it comes in contact with the post serving as a line post. The length of the rear portion cut-out of the rail is substantially equal to that part of the rear face portion of its corresponding support member that is in contact with the post. When the post serves as a corner post, FIG. 19 illustrates cut-out of the rear portion of the rail similar to that of FIG. 17, with an additional angled cut-out on the top portion of the rail so that the rail may suitably mate at the corner post with a second appropriately cut rail. In the example shown, the top portion of the rail is cut-out at a 45° angle.

Significantly, the plurality of pickets 12 and the at least one transverse rail 14 are formed as a unitary piece and are adapted to mate with like unitary pieces together to provide a modular fence construction. Unitary piece 10, sleeve 34 and post cap 36 are all comprised of a plastic resin and preferably are formed in an injection molding process. Various cross-sectional views are provided in FIGS. 4–7 of the drawings to more fully illustrate the features of the present invention.

Figure 20:
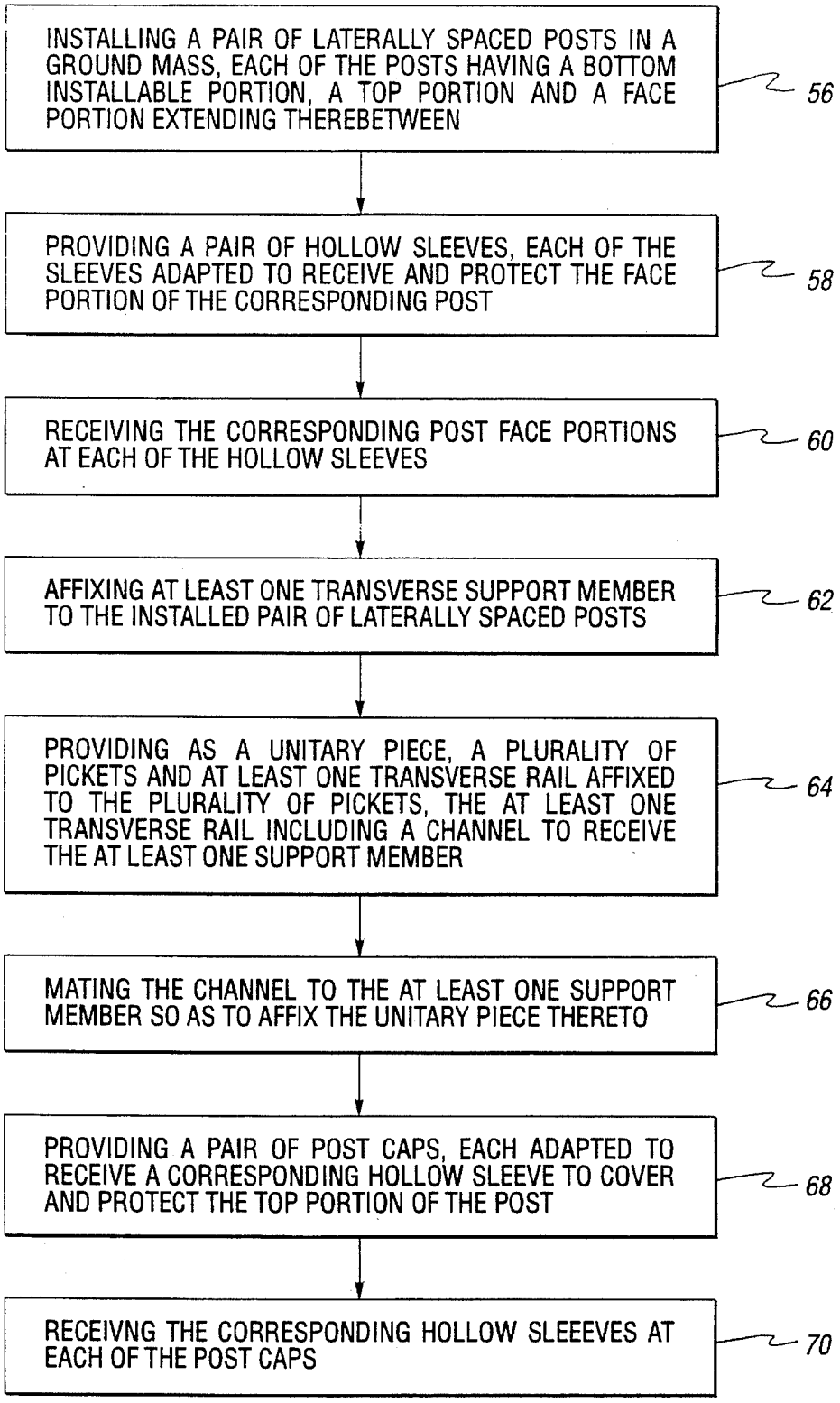
FIG. 20 is a flow diagram of the method steps of the present invention.

Referring now to FIG. 20 of the drawings, there is provided a flow diagram of the method steps of the present invention. As in the case of the fence construction discussed above, the method requires the initial installation of a pair of laterally spaced posts 18 and 20 in the ground mass 22. Each of the posts has a bottom installable portion 28, a top portion 30 and a face portion 32 extending therebetween. This installation step is described generally at block 56. Thereafter, as shown in block 58, a pair of hollow sleeves are provided, each being adapted to receive and protect the face portion of the corresponding post. The corresponding fence post portions are received by the hollow sleeves as indicated at block 60 and at least one transverse support member is affixed to the pair of installed posts as shown at block 62. Thereafter, a plurality of pickets and at least one transverse rail affixed thereto are provided as a unitary piece. In keeping with the invention, the rail includes a channel to receive the at least one support member. This method step is indicated more thoroughly at block 64. The channel may thereafter be mated to the at least one support member so as to affix the unitary piece thereto as shown in block 66. By providing a pair of post caps, each adapted to receive a corresponding hollow sleeve 34, the fence post top portion may thereafter be covered and protected from the elements. See, blocks 68 and 70.

While the best mode for carrying out the invention has been described in detail, those familiar with the art to which this invention relates will recognize various alternative designs and embodiments for practicing the invention as defined by the following claims.

What is claimed is:

1. A pair of posts installed in a ground mass, said posts laterally spaced from each other and having at least one transverse support member extending therebetween, a modular fence construction, comprising:

a plurality of pickets; and at least one transverse rail affixed to said plurality of pickets, said rail including a channel adapted to receive said at least one transverse support member along substantially the entire length thereof, said plurality of pickets and said at least one transverse rail formed as a unitary piece and adapted to mate with like unitary pieces so as to provide said modular fence construction.

2. A modular fence construction as in claim 1, wherein said pair of posts are substantially vertical.

3. A modular fence construction as in claim 1, wherein said at least one transverse support member is substantially horizontal.

4. A modular fence construction as in claim 1, wherein said at least one transverse support member has a top face portion, a bottom face portion, a front face portion, and a rear face portion.

5. A modular fence construction as in claim 1, wherein said unitary piece is comprised of plastic resin.

6. A modular fence construction as in claim 1, wherein said unitary piece is comprised of plastic formed in an injection molding process.

7. A modular fence construction as in claim 4, wherein said at least one transverse rail comprises a rear portion to cover said rear face portion of said at least one transverse support member, a top portion to cover said top face portion of said at least one transverse support member, and a front portion to cover said front face portion of said at least one transverse support member.

8. A modular fence construction as in claim 1, further comprising a pair of hollow sleeves, each adapted to receive and protect a corresponding post.

9. A modular fence construction as in claim 8, further comprising a pair of post caps, each adapted to receive a corresponding hollow sleeve.

10. A pair of posts installed in a ground mass, said posts laterally spaced from each other and having a top transverse support member and a bottom transverse support member affixed thereto, wherein said top and bottom transverse support members extend between said posts, a modular fence construction, comprising:

a plurality of pickets;

a top transverse rail affixed to said plurality of pickets, said top transverse rail including a top rail channel adapted to receive said top transverse support member along substantially the entire length thereof; and a bottom transverse rail affixed to said plurality of pickets, said bottom transverse rail including a bottom rail channel adapted to receive said bottom transverse support member along substantially the entire length thereof, said plurality of pickets and said top and bottom transverse rails formed as a unitary piece and adapted to mate with like unitary pieces so as to provide said modular fence construction.

11. A modular fence construction as in claim 10, wherein said pair of posts are substantially vertical.

12. A modular fence construction as in claim 10, wherein said top transverse support member is substantially horizontal.

13. A modular fence construction as in claim 10, wherein said bottom transverse support member is substantially horizontal.

14. A modular fence construction as in claim 10, wherein said top transverse support member has a top face portion, a bottom face portion, a front face portion, and a rear face portion.

15. A modular fence construction as in claim 10, wherein said bottom transverse support member has a top face portion, a bottom face portion, a front face portion, and a rear face portion.

16. A modular fence construction as in claim 14, wherein said top transverse rail comprises a rear portion to cover said rear face portion of said top transverse support member, a top portion to cover said top face portion of said top transverse support member, and a front portion to cover said front face portion of said top transverse support member.

17. A modular fence construction as in claim 15, wherein said bottom transverse rail comprises a rear portion to cover said rear face portion of said bottom transverse support member, a top portion to cover said top face portion of said bottom transverse support member, and a front portion to cover said front face portion of said bottom transverse support member.

18. A modular fence construction as in claim 10, wherein said unitary piece is comprised of plastic resin.

19. A modular fence construction as in claim 10, wherein said unitary piece is comprised of plastic formed in an injection molding process.

20. A modular fence construction as in claim 10, further comprising a pair of hollow sleeves, each adapted to receive and protect a corresponding post.

21. A modular fence construction as in claim 20, further comprising a pair of post caps, each adapted to receive a corresponding hollow sleeve.

22. A modular fence construction, comprising:

a pair of posts installed in a ground mass and laterally spaced from each other;

at least one transverse support member affixed to said pair of posts and extended therebetween;

a plurality of pickets; and at least one transverse rail affixed to said plurality of pickets, said at least one transverse rail including a channel adapted to receive said at least one transverse support member along substantially the entire length thereof, said plurality of pickets and said at least one transverse rail formed as a unitary piece and adapted to mate with like unitary pieces so as to provide said modular fence construction.

23. A modular fence construction as in claim 22, wherein said pair of posts are substantially vertical.

24. A modular fence construction as in claim 22, wherein said at least one transverse support member is substantially horizontal.

25. A modular fence construction as in claim 22, wherein said at least one transverse support member has a top face portion, a bottom face portion, a front face portion, and a rear face portion.

26. A modular fence construction as in claim 25, wherein said at least one transverse rail comprises a rear portion to cover said rear face portion of said at least one transverse support member, a top portion to cover said top face portion of said at least one transverse support member, and a front portion to cover said front face portion of said at least one transverse support member.

27. A modular fence construction as in claim 22, wherein said unitary piece is comprised of plastic resin.

28. A modular fence construction as in claim 22, wherein said unitary piece is comprised of plastic formed in an injection molding process.

29. A modular fence construction as in claim 22, further comprising a pair of hollow sleeves, each adapted to receive and protect a corresponding post.

30. A modular fence construction as in claim 29, further comprising a pair of post caps, each adapted to receive a corresponding hollow sleeve.

31. An improved fence construction method, comprising:

installing a pair of laterally spaced posts in a ground mass;

affixing at least one transverse support member to said pair of installed laterally spaced posts such that said transverse support members extend therebetween;

providing as a unitary piece, a plurality of pickets and at least one transverse rail affixed to said plurality of pickets, said at least one transverse rail including a channel adapted to receive said at least one transverse support member, along substantially the entire length thereof; and mating said channel to said at least one transverse support member so as to affix said unitary piece thereto and provide said fence construction.

32. An improved fence construction method, comprising:

installing a pair of laterally spaced posts in a ground mass, each of said posts having a bottom installable portion, a top portion and face portion extending therebetween;

providing a pair of hollow sleeves, each of said sleeves adapted to receive and protect the face portion of a corresponding post;

receiving said corresponding post face portions at each of said hollow sleeves;

affixing at least one transverse support member to said installed pair of laterally spaced posts such that said transverse support members extend therebetween;

providing as a unitary piece, a plurality of pickets and at least one transverse rail affixed to said plurality of pickets, said at least one transverse rail including a channel adapted to receive said at least one transverse support member, along substantially the entire length thereof; and mating said channel to said at least one support member so as to affix said unitary piece thereto;

providing a pair of post caps, each adapted to receive a corresponding hollow sleeve to cover and protect said top portion of the post; and receiving said corresponding hollow sleeves at each of said post caps.

* * * * *